United States Patent [19]

Kusumoto

[11] 3,948,035

[45] Apr. 6, 1976

[54] TIME INDICATION SETTING CIRCUIT

[75] Inventor: Yasuo Kusumoto, Tokyo, Japan

[73] Assignee: Kabushiki Kaisha Daini Seikosha, Japan

[22] Filed: Aug. 14, 1974

[21] Appl. No.: 497,371

[30] Foreign Application Priority Data

Aug. 14, 1973 Japan ..... 48-91042

[52] U.S. Cl. ..... 58/23 R; 58/85.5

[51] Int. Cl.² ..... G04C 3/00; G04B 27/00

[58] Field of Search ..... 58/23 D, 23 R, 50 R, 85.5

[56] References Cited

UNITED STATES PATENTS

| | | | |
|---|---|---|---|
| 3,672,155 | 6/1972 | Bergey et al. | 58/50 R |
| 3,841,081 | 10/1974 | Komaki | 58/23 R |

*Primary Examiner*—Edith Simmons Jackmon
*Attorney, Agent, or Firm*—Robert E. Burns; Emmanuel J. Lobato; Bruce L. Adams

[57] ABSTRACT

A time indication setting circuit for accelerating or stopping the advance of the time indicating mechanism in an electronic timepiece. A delay circuit receives time pulses developed within the timepiece and the time pulses and delayed time pulses from the delay circuit are applied to a gate circuit. The gate circuit applies the time pulses and the delayed time pulses, under the control of a control circuit, to the timepiece drive train to drive the timepiece time indicating mechanism at a rate determined by the pulse repetition rate of the pulses applied to the drive train. The control circuit is manually operable to apply the control signal so the gate circuit applies both the time and the delayed time pulses to the drive train and thereby accelerates the advance of the time indicating mechanism, or to block both the time and the time indicating pulses and thereby stop the advance of the time indicating mechanism or to apply only the time pulses to the drive train so that the time indicating mechanism advances at a normal rate.

6 Claims, 6 Drawing Figures

TIME INDICATION SETTING CIRCUIT

BACKGROUND OF THE INVENTION

This invention relates generally to time indication setting mechanisms for timepieces and more particularly to a new and improved time indication setting circuit for an electronic timepiece.

Timepieces generally have a time indication setting mechanism for manually setting the time indication of the timepiece. Generally, conventional time indication setting mechanisms disengage the time indicating hands from the drive train of the timepiece so that they may be positioned to indicate a particular time. Then the conventional time indication setting mechanism is actuated to again engage the time indicating hands with the drive train of the timepiece. In order that the timepiece indicate the time accurately, the time indicating hands of the timepiece must be engaged with the drive train of the timepiece at exactly the time indicated by the time indicating hands. This is difficult to carry out in practice so that it is not always possible to obtain exact time settings with conventional time indication setting mechanisms.

SUMMARY OF THE INVENTION

It is a principal object of the present invention to provide a new and improved time indicating setting circuit for electronic timepieces.

Another object is to provide a time indication setting circuit for an electronic timepiece for advancing or stopping the time indicating hands of the timepiece for one second intervals.

In accordance with the present invention an electronic timepiece having a time standard oscillator developing a time signal comprising time pulses at one second intervals is provided with gate circuit means for passing or blocking the time pulses to be applied to the timepiece drive train. The output pulses of the time standard oscillator are simultaneously applied to the gate circuit and to means for delaying the time pulses. The delayed time pulses are also applied to the gate circuit. A control circuit including a stop mode switch and an advance mode switch receives the time pulses and the delayed time pulses and applies control signals to the gate circuit. Actuation of the stop mode switch applies a stop signal to the gate circuit. In response to the stop signal the gate circuit is switched to a blocking mode in which it blocks the next time pulse applied thereto. Each time the stop mode switch is actuated a stop signal is applied to the gate circuit to switch the gate circuit to the blocking mode. Actuation of the advance mode switch applies an advance signal to the gate circuit to switch the gate circuit to an advance mode of operation. In the advance mode of operation the gate circuit passes the time signals applied thereto and passes the next delayed time pulse applied after the gate circuit is switched to the advance mode. The delayed time pulse passed by the gate circuit, when in the advance mode, advances the time indication of the timepiece ahead of the normal advance, due to the time pulses, by one second.

BRIEF DESCRIPTION OF THE DRAWINGS

Other features and advantages of the time indication setting circuit in accordance with the present invention will be better understood as described in the following specification and appended claims, in conjunction with the following drawings in which:

DESCRIPTION OF THE PREFERRED EMBODIMENT

Figure 1:
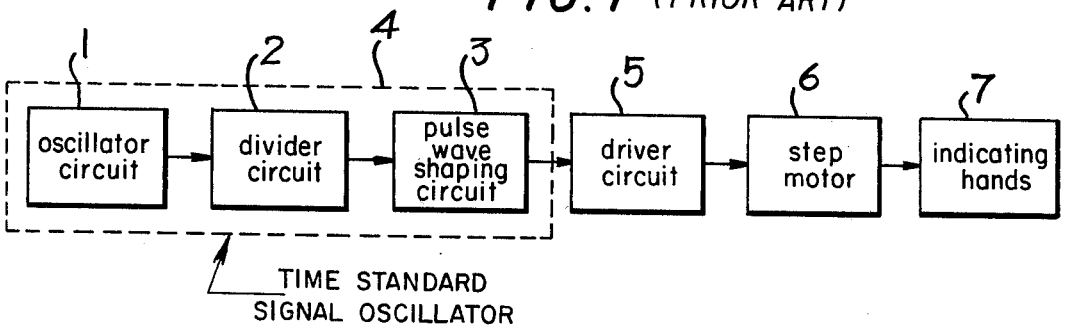
FIG. 1 (PRIOR ART)
FIG. 1 is a circuit diagram of a conventional electronic timepiece.

A conventional electronic timepiece generally includes an oscillator 1. A divider circuit 2 receives the oscillator 1 output signal for developing an output frequency having a frequency lower than the oscillator frequency. Pulse wave shaping circuit 3 shapes the output pulses of the divider 2. The oscillator 1, divider 2 and wave shaping circuit 3 together comprise a time standard oscillator 4 for providing time pulses to the drive train of the electronic timepiece. The time pulses generally occur at one second intervals.

The drive train of the timepiece includes a driver circuit 5 for amplifying the time pulses and applying the amplified time pulses to a stepping motor 6. The stepping motor 6 advances at the pulse repetition rate of the time pulses and drives the time indicating hands or a time indicating mechanism of the timepiece, for example through an associated gear train, not shown.

Figure 2:
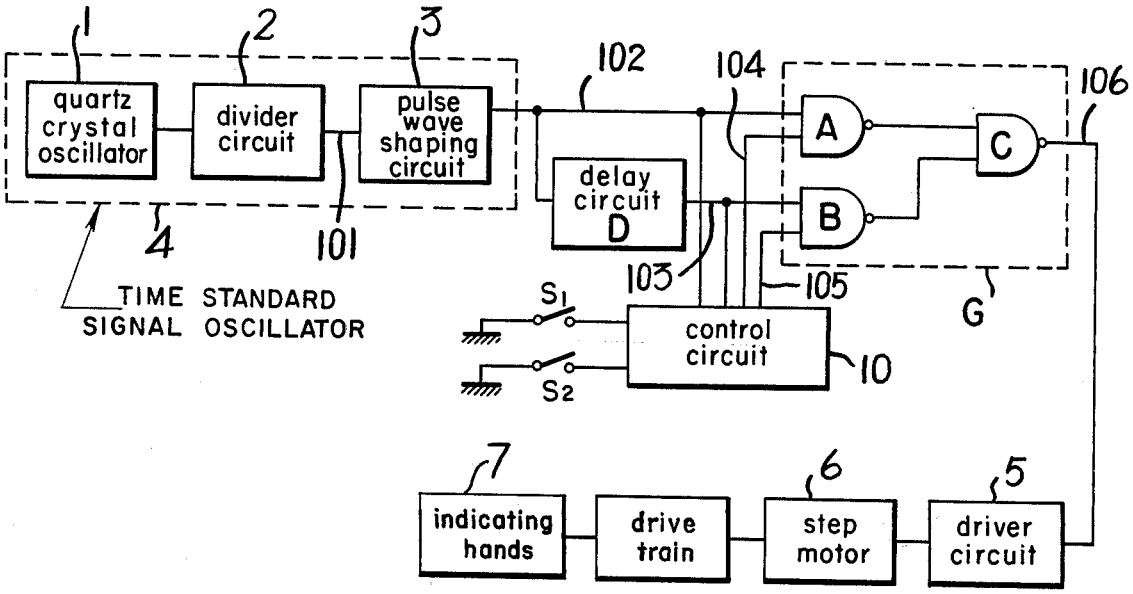
FIG. 2 is a circuit diagram of an electronic timepiece including a time indication setting circuit according to the present invention.

The time indicating control circuit according to the present invention is disposed between the time standard oscillator 4 of an electronic timepiece and the driver circuit 5 to control the application of the time pulses to the driver circuit 5 as shown in FIG. 2. The time indication setting circuit according to the invention comprises a delay circuit D, a gate circuit G and a control circuit 10. In operation, time pulses developed by the time standard oscillator 4 are applied to a circuit path 102 and the delay circuit D. The time pulses conducted by the circuit path 102 are applied to the gate circuit G and the control circuit 10 while the time pulses delayed by the delay circuit D are applied by circuit path 103 to the gate circuit G and the control circuit 10.

Figure 3:
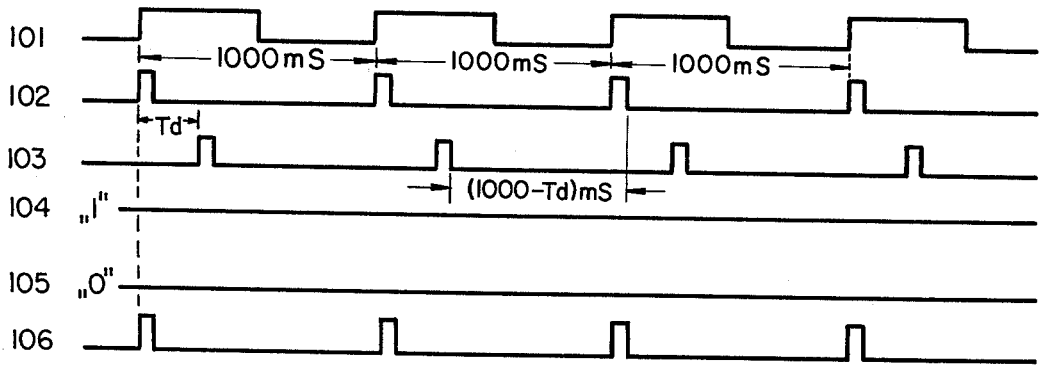
FIG. 3 is a diagram of the waveforms occurring in an electronic timepiece circuitry embodying the present invention.

The waveforms occurring during the normal operation of the timepiece are shown in FIG. 3 and each is identified by the circuit path through which it is conducted. In this embodiment, the divider 2 develops an output pulse train having a period of one second which is applied to the wave shaping circuit 3. The time pulse output signal of the time standard oscillator 4 is a pulse train of narrow pulses having a period of one second. The time pulses are also applied to the delay circuit D and delayed by an interval Td as shown by waveform 103 in the FIG. 3. During the normal operation of the timepiece the waveform 104 is constant and non-zero and the waveform 105 is zero. The output of the gate circuit G has a waveform 106 identical with the waveform 102 of the time standard oscillator output.

Figure 4:
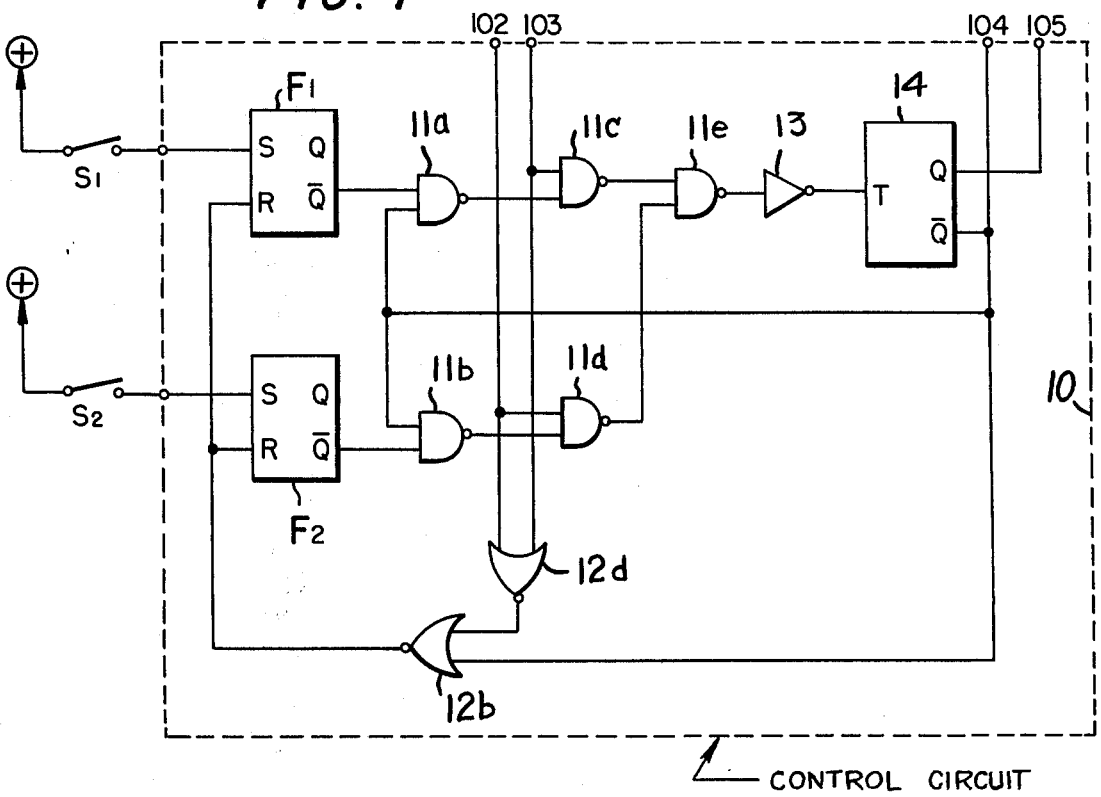
FIG. 4 is a circuit diagram of a control circuit according to the present invention.
Figure 5:
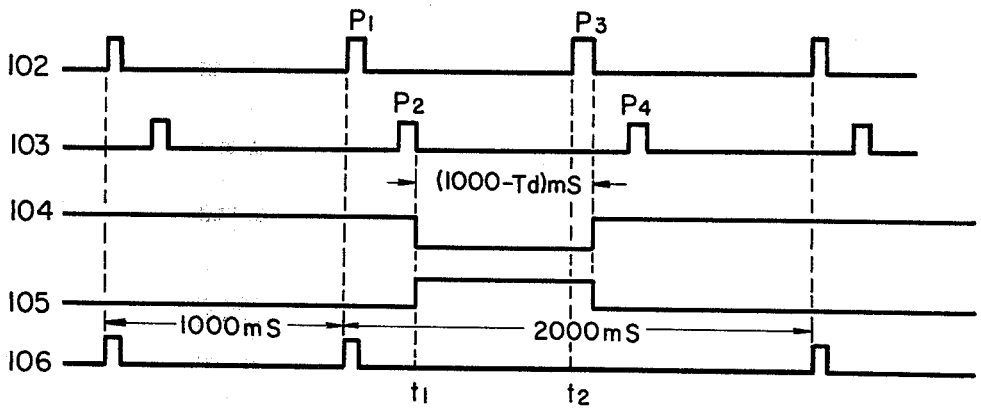
FIG. 5 is a diagram of the waveforms occurring during a stop mode of operation of the circuitry in FIG. 2.

To illustrate the time setting operation as carried out by the present invention, the operation of the time indication setting circuit in the stop mode, and particularly the operation of the control circuit 10 shown in FIG. 4, will be analyzed in detail. The waveforms occurring during the stop mode of operation are shown in FIG. 5. The outputs of the logic circuits will be described in terms of the logic levels 0 and 1. These logic levels may correspond to the presence or absence of a voltage, or a positive or negative polarity or some other parameter having two conditions.

Assume the stop mode switch S1 is open prior to time *t*1. Then at an instant of time just prior to the time *t*1 the output of the flip-flop F1 is 1 which is applied to the input of Nand gate 11*a*. The output of flip-flop F2 remains at 1 and is applied to the input of Nand gate 11*b*. As seen from waveform 104 in FIG. 5 the output of the monostable multivibrator 14 is 1 which is applied to an input of both of the Nand gates 11*a* and 11*b* so that the output of both of the Nand gates 11*a* and 11*b* are 0. The output of Nand gate 11*a* is applied to one input of the Nand gate 11*c* while the delayed time pulses are applied to the other input of the Nand gate 11*c* by the circuit path 103. Just prior to time *t*1 pulse P2 is present on conductor 103 so that the output of the Nand gate 11*c* is zero. The output of Nand gate 11*b* is applied to the Nand gate 11*d* as are the time pulses by circuit path 102. Because at a time just prior to time *t*1 no time pulse is applied to the Nand gate 11*d*, the output of the Nand gate 11*d* is 1. The two Nand gates 11*c* and 11*d* apply their outputs 0 and 1, respectively, to Nand gate 11*e* which develops a 1 output. The output of Nand gate 11*e* is inverted by inverter 13 so that 0 is applied to the monostable multivibrator trigger input T. Consequently, the monostable multivibrator 14 does not change state and the condition of the control circuit 10 just prior to time T1 is stable.

At time *t*1 the delayed time pulse P2 terminates so that the signal applied by circuit path 103 to the Nand gate 11*c* goes to 0. As a result the output of Nand gate 11*c* goes to 1. When the output of Nand gate 11*c* switches from 0 to 1 two inputs of 1 level are applied to the Nand gate 11*e* so that the output of Nand gate 11*e* changes to 0 and the output of the inverter 13 changes to 1. At this time the output of the monostable multivibrator changes so that the inverting output Q switches to 0 and the non-inverting output Q switches to 1 as shown by the waveforms 104 and 105 at time *t*1 in FIG. 5.

After time *t*1 and before time *t*2 both inputs of Nand gate A in the gate circuit G are receptive of 0 level signals while the Nand gate B is receptive of 0 level and 1 level signal. Thus, the outputs of both of the Nand gates A and B are 1 so that the output of Nand gate C is 0 and no signal is present on the circuit path 106. At time *t*2, when the time pulse P3 is applied to circuit path 102, the signal applied by the circuit path 104 to Nand gate A is 0 so that the pulse P3 does not change the output of the Nand gate A. Consequently, no output is developed by gate circuit G at time *t*2 in response to the time pulse P3.

As shown by waveform 106 in FIG. 5 no pulse is applied to the driver circuit 5 at time *t*2 so that the stepping motor 6 is not energized to advance the time indicating hands of the timepiece at time *t*2. Thus, the time indication of the timepiece is effectively set back with reference to an external time reference. By repeatedly actuating the stop mode switch S1 the gate circuit may be maintained in the stop mode to continually set back the time indication of the timepiece until a desired time is indicated.

Figure 6:
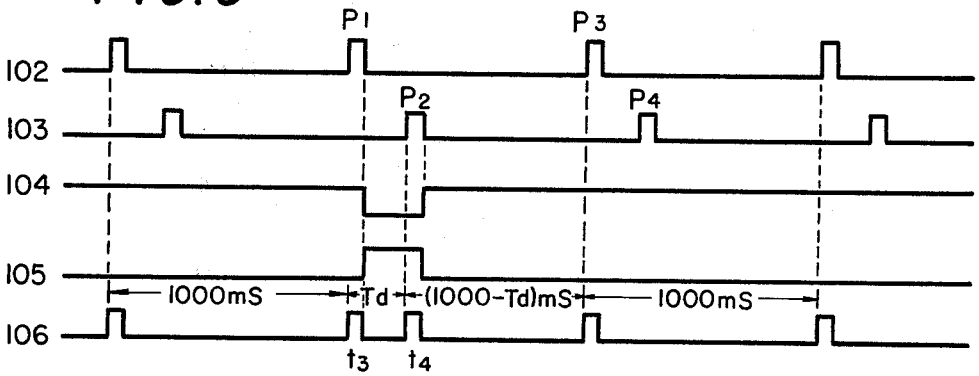
FIG. 6 is a diagram of the waveforms occurring during the advance mode of operation of the circuitry in FIG. 2.

The time indication setting circuit is operated in the advance mode by actuating the advanced mode switch S2. When the time pulse P1 terminates at *t*3 the monostable multivibrator changes state so that the signal on circuit path 104 changes to 0 and the signal on circuit path 105 changes to 1. The control circuit remains in this condition until the termination of the delayed time pulse P2. During this time interval Nand gate A has 0 applied to both inputs and Nand gate B has a 1 applied by circuit path 105 to one of its inputs. At time *t*4 the delayed time pulse P2 is applied to the other input of the Nand gate B by circuit path 103 and at this time the output of Nand gate B goes to 0. Consequently, the output of Nand gate C goes to 1 for the duration of the delayed time pulse P2. The pulse developed by the gate circuit G responds to the delayed time pulse P2 is shown by waveform 106 at time *t*2 in FIG. 6. This pulse is applied to the driver circuit 5 and energizes the stepping motor 6 to advance the time indication of the timepiece by 1 second. Thus, the timepiece gains one second with reference to an external time standard. By repeatedly actuating the advanced mode swtich S2 the timepiece will continually gain time at a rate faster than that due to the time pulses.

While a preferred embodiment of the invention has been shown and described it will be understood that many modifications and changes can be made within the spirit and scope of the invention. Particularly, the logic circuits comprising gate G and the control circuit 10 may assume many different structures.

What I claim and desire to secure by Letters Patent is:

1. A time indication setting circuit for an electronic timepiece comprising:

a. delay means for receiving an electrical time signal for delaying said electrical time signal;

b. a control circuit receptive of said time signal and the delayed time signal comprising means responsive to only said time and delayed time signals for selectively developing an electrical stop signal and means responsive to only said time and delayed time signals for selectively developing an electrical advance signal; and c. gate means having an output and receptive of said time signal, said delayed time signal, said stop signal and said advance signal for applying said time signal and said delayed time signal to said output in response to said advance signal applied to said gate means, for blocking the application of any signal to said output in response to said stop signal applied to said gate means and for applying said time signal to said output in the absence of said stop signal and said advance signal applied to said gate means.

2. A time indication setting circuit according to claim 1 wherein said gate means comprises a first Nand gate and a second Nand gate each having a pair of inputs and an output, a third Nand gate having a pair of inputs and an output, and means electrically connecting one of the inputs of said third Nand gate to said output of said first Nand gate and electrically connecting the other of the inputs of said third Nand gate to said output of said second Nand gate.

3. A time indication setting circuit according to claim 1 wherein said control means comprises:

a. a first and a second flip-flop each having a set input, a re-set input, an inverting output and a non-inverting output;

b. means defining a circuit path having a stop mode switch operable for controlling the application of a voltage to the set input of said first flip-flop;

c. means defining a circuit path having an advance mode switch operable for controlling the application of a voltage to the set input of said second flip-flop;

d. a monostable multivibrator having a trigger input, an inverting output and a non-inverting output;

e. a first Nor gate having a pair of inputs and an output;

f. a first and a second Nand gate each having a pair of inputs and an output;

g. means electrically connecting one of the inputs of said first Nand gate to the inverting output of said first flip-flop;

h. means electrically connecting one of the inputs of said second Nand gate to the inverting output of said second flip-flop;

i. means electrically connecting the remaining inputs of said first and said second Nand gates to the inverting output of said monostable multivibrator;

j. a third and a fourth Nand gate each having a pair of inputs and an output;

k. means electrically connecting the output of said Nand gate to an input of said third Nand gate;

l. means electrically connecting the output of said second Nand gate to an input of said fourth Nand gate;

m. means for applying said time signal to an input of said first Nor gate and to the remaining input of said fourth Nand gate;

n. means for applying said delayed time signal to the remaining input of said first Nor gate and to the remaining input of said third Nand gate;

o. a fifth Nand gate having a pair of inputs and an output;

p. means electrically connecting the output of said third Nand gate to an input of said fifth Nand gate and the output of said fourth Nand gate to the other input of said fifth Nand gate;

q. an inverter having means electrically connecting an input of said inverter to the output of said fifth Nand gate and having means electrically connecting an output of said inverter to the trigger input of said monostable multivibrator;

r. a second Nor gate having a pair of inputs and an output;

s. means electrically connecting the output of said second Nor gate to the reset input of each of said first and said second flip-flops;

t. means electrically connecting the output of said first Nor gate to an input of said second Nor gate; and u. means electrically connecting the other input of said second Nor gate to the inverting output of said monostable multivibrator.

4. An electronic timepiece having a time standard oscillator for developing first electrical time signals; a time indicating mechanism and a drive train energized by said first time signals for driving said time indicating mechanism in response to said first time signals to indicate time; wherein the improvement comprises means for developing second electrical time signals; a control circuit receptive of said first and said second time signals comprising means responsive to only said first and second electrical time signals for developing an electrical stop signal and means responsive to only said first and second electrical time signals for developing an electrical advance signal; and gate means receptive of said first and said second time signals, said stop signal and said advance signal for applying said first and said second time signals to said drive train in response to said advance signal applied to said gate means to thereby accelerate the rate of driving of said time indicating mechanism, for blocking the application of any signal to said drive train in response to said stop signal applied to said gate means to thereby stop the driving of said time indicating mechanism, and for applying said first time signals to said drive train in the absence of said stop signal and said advance signal applied to said gate means to thereby drive the time indicating mechanism at a normal rate determined by said first time signals.

5. An electronic timepiece according to claim 4 wherein said means for developing second time signals comprise delay means receptive of said first time signals for developing delayed first time signals which comprise said second time signals.

6. An electronic timepiece according to claim 4 wherein said time standard oscillator develops first time signals comprising a periodic pulse train, said means for developing an electrical stop signal includes means manually operable to enable said means for developing an electrical stop signal to develop said stop signal for a duration less than the period of said pulse train, and said means for developing an electrical advance signal includes means manually operable to enable said means for developing an electrical advance signal to develop said advance signal for a duration less than the period of said pulse train.

* * * * *